United States Patent [19]

Vigneau

[11] Patent Number: 4,666,400

[45] Date of Patent: May 19, 1987

[54] RADIANT GAS BURNER

[76] Inventor: David L. Vigneau, 12 Payan St., West Warwick, R.I. 02893

[21] Appl. No.: 859,415

[22] Filed: May 5, 1986

[51] Int. Cl.[4] ..... F23D 13/12

[52] U.S. Cl. ..... 431/328

[58] Field of Search ..... 431/328, 329; 126/92 AC

[56] References Cited

U.S. PATENT DOCUMENTS

| | | | |
|---|---|---|---|
| 3,824,064 | 7/1974 | Bratko | 431/328 |
| 4,035,132 | 7/1977 | Smith | 431/328 X |
| 4,189,297 | 2/1980 | Bratko et al. | 431/328 |
| 4,255,123 | 3/1981 | Bishilany et al. | 431/328 |
| 4,373,904 | 2/1983 | Smith | 431/328 |
| 4,378,207 | 3/1983 | Smith | 431/328 |
| 4,416,618 | 11/1983 | Smith | 431/328 |
| 4,435,155 | 3/1984 | Vigneau | 431/328 |
| 4,492,564 | 1/1985 | Wolf | 431/328 |
| 4,634,373 | 1/1987 | Rattner | 431/328 |

FOREIGN PATENT DOCUMENTS

| | | | |
|---|---|---|---|
| 2203510 | 8/1973 | Fed. Rep. of Germany | 431/328 |

*Primary Examiner*—Margaret A. Focarino
*Attorney, Agent, or Firm*—Barlow & Barlow

[57] ABSTRACT

A radiant gas burner has a gas plenum and a surrounding non-combustible gas plenum. In this structure, a matrix which is gas permeable is clipped into the first gas plenum by means of a sintered metal plate that extends from the wall of the non-combustible gas plenum over the peripheral edge of the matrix. The sintered metal allows both combustible and non-combustible gas to pass there through with substantially the same velocity.

5 Claims, 6 Drawing Figures

RADIANT GAS BURNER

BACKGROUND OF THE INVENTION

The present invention relates to an infrared gas burner, more particularly, an improvement in the manner of which the matrix is held in the supporting structure. In my prior patent U.S. Pat. No. 4,435,154 there is disclosed a radiant gas burner in which the matrix is held in the gas plenum by a plurality of fasteners that screw in to the side edge of the matrix. Another way of holding a matrix in place is illustrated in the Smith U.S. Pat. No. 4,035,132 where a flange engages the outer face of the matrix to hold the same in place. One of the problems that is associated with this later type of gas burner relates to the heat that is generated on the face of the matrix as the heat can damage the structure that holds the matrix in position. One of the early suggestions of controlling the heat is found in the Bratko U.S. Pat. No. 3,824,064 and subsequent to that time there have been many suggestions of eliminating the problem by introducing air or other non-combustible gas at the peripheral of the matrix as seen in a later Bratko U.S. Pat. No. 4,189,297. Essentially, in these prior art devices the perimeter of the matrix has a non-combustible gas either forced there through from the rear face as in the Smith Patent or a non-combustible curtain of gas is forced through the area adjacent the edge of the matrix so as to prevent heat spill over and to cool the mounting means that hold the matrix in place.

While the curtain of gas approach even as seen in my prior U.S. Pat. No. 4,435,154 is feasible it does require rather accurate control of the non-combustible gas in order to control the spill over effect, that is where the gas burning on the face of the matrix tends to spill over into the area in which the non-combustible gas is exiting.

One of the principal objects of this invention, therefore, is to provide a radiant gas burner which utilizes a permeable matrix and which is fastened with a peripheral flange that is made from sintered metal.

Further object of the invention is to provide a sintered metal clamping structure which has a porosity substantially equal to the matrix so that an non-combustible gas curtain may pass through the sintered metal at substantially the same rate that the combustible gas mixture passes through the permeable matrix thus allowing the flame to burn out to the edge of the matrix.

DETAILED DESCRIPTION OF THE PREFERRED EMBODIMENT

Figure 1:
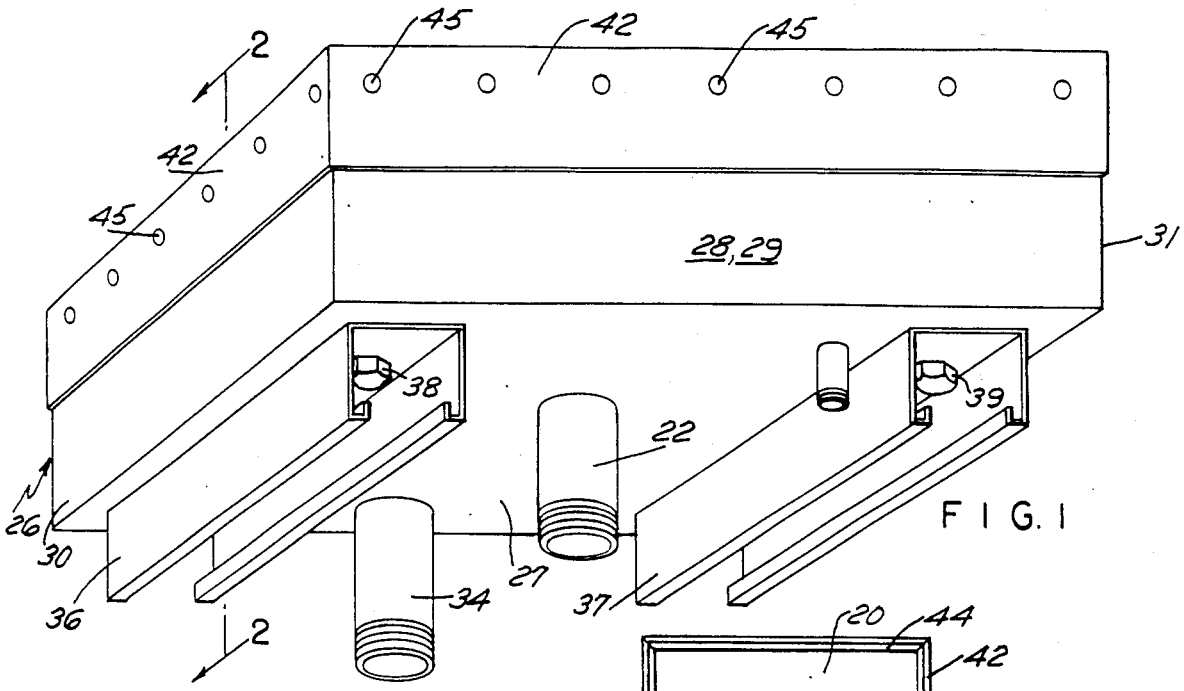
FIG. 1 is perspective view of the radiant gas burner of the invention taken from the backside thereof opposite the matrix.
Figure 5:
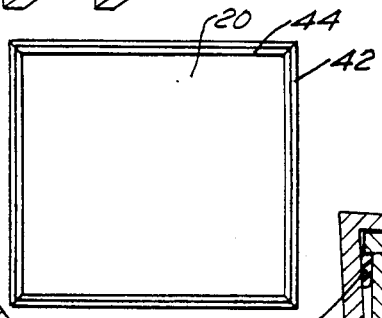
FIG. 5 is a plan view on a reduced scale of the radiant gas burner of the invention.
Figure 2:
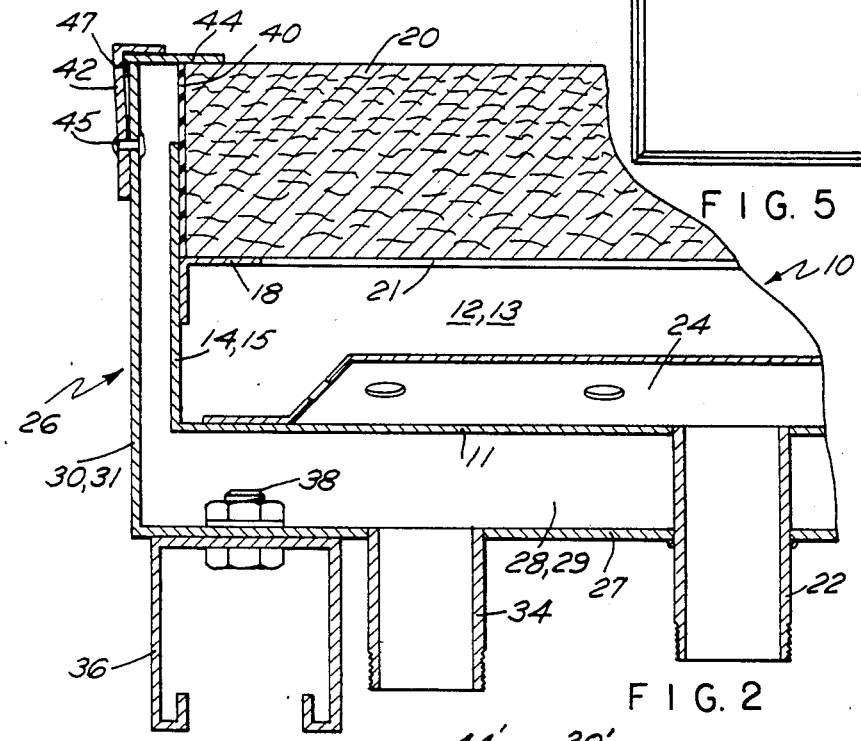
FIG. 2 is a sectional view thereof taken on lines 2—2 of FIG. 1.
Figure 3:
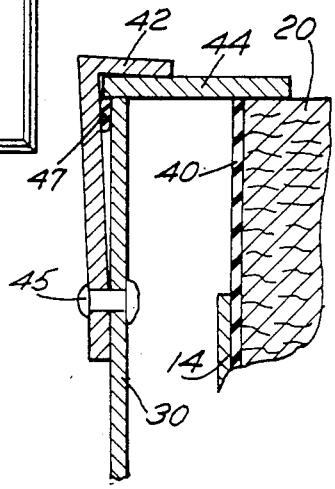
FIG. 3 is an enlarged view of the matrix securing structure.

The radiant gas burner of the instant invention includes the usual air/gas plenum which may be suitably formed of sheet metal to provide a top wall 11, end walls 12 and 13, and side walls 14 and 15. Extending about the interior of the side and end walls is an angle support plate 18 which forms a shelf against which the bottom wall 21 of matrix 20 may rest which angle shelf is suitably spot welded to the side and end walls. The gas/air plenum is fed with the proper combustion mixture through an inlet pipe 22 and is then disbursed in the plenum by a baffle 24 that is secured to the top inner face of the top wall 11.

A second plenum 26 surrounds the plenum 10 and is constructed of a top wall 27, side walls 28, 29 and end walls 30, 31. The non-combustible gas plenum 26 is fed with a supply through a duct 34 and to support the burner there are provided Unistrut supports 36, 37 which are fastened to the top wall 27 by bolt fasteners such as 38, 39.

Figure 4:
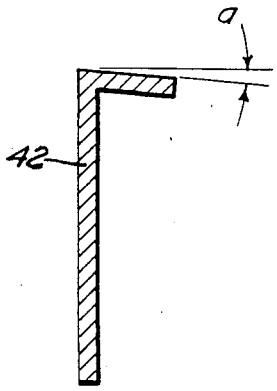
FIG. 4 is a diagrammatic view illustrating the manner in which the clamp for the sintered metal is formed.

The matrix 20 is provided about its side and end walls with a silicone rubber sealant 40 so as to prevent any transfer of non-combustible gas and combustible gas there through. In normal operation the non-combustible gas is at a slightly higher pressure. To hold the matrix in position angled clips 42 have spot welded thereto a sintered metal plate such as 44, there being four clips 42 secured to the side and end walls of the second plenum preferably by the utilization of pop rivets such as 45. The clips are formed as seen in FIG. 4 so that angle a is approximately 15°. This provides a line contact against the sintered metal approximately midway between the first and second plenum side walls. Between the side and end walls of the second plenum and the angled clips such as 42, there is provided a gasketing 47 which extends completely around all of the side and end walls. The gasketing can be of teflon or glass fiber string or equivalent and restricts the escape of any gas beyond the sintered metal 44. The sintered metal 44 is specifically chosen with a porosity that is substantially equal to the porosity of the matrix 20. For example, in a matrix 20 that exhibits approximately 4.75 inch static pressure, a 10 micron 1/16 inch thick sintered metal is chosen which will exhibit 5 inches static pressure. Accordingly, while the matrix utilizes the aforementioned static pressure to provide effective combustion over the outer face thereof, it will be appreciated that by matching the static pressures of the matrix and the sintered metal, the non-combustible gas will pass up through the sintered metal 44 immediately adjacent the edges of the matrix 20 at the same velocity as the combustible gas which will prevent the flame burning on the face of the matrix to go out to the edge of the matrix but not beyond and there will be absolutely no spill over under these conditions. It will also be appreciated that with this situation the whole face of the matrix can be utilized and the clamp holding the matrix in place will be kept cool, whether or not the burners are positioned so that the outer face of the matrix is vertical or is positioned facing downwardly. Essentially therefore, the marginal non-combustible gas stream acts as a barrier layer against the hot combustion products from moving outwardly and damaging the second plenum 26. Moreover, the non-combustible gas passing through the space between the inner plenum and the outer plenum maintains the sealant 40 at a temperature where materials such as silicone rubber may be utilized that need not be a resistant to high temperature.

Figure 6:
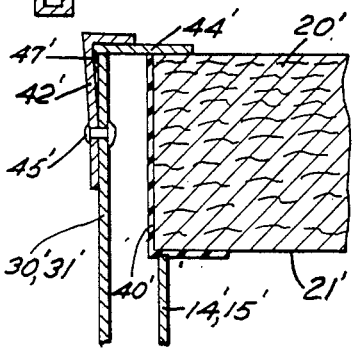
FIG. 6 is a partial view of a slightly modified form of the invention.

Referring to FIG. 6 wherein like parts bear the same reference numeral with a prime, an alternate form of matrix support is illustrated in which the matrix rests upon the top edges of gas plenum walls 14, 15. In this construction the sealant 40 is extended from the side and end walls to an edge portion of the bottom wall 21 so that the top edges of the walls are tightly sealed. In all other respects the construction is identical.

It will also be appreciated that the clips 42 and the sintered metal 44 need not have mitered joints or maintain a close fit as has been necessary in certain prior art structures. As a matter of fact, mitered joints are not necessary and merely butt joints are permissible since over a very small area it is not necessary to provide any particular sealing.

I claim:

1. In a radiant gas burner having a gas permeable matrix supported on a gas plenum having a peripheral wall and a frame having a wall spaced from the peripheral wall of the gas plenum forming a duct through which a different gas is discharged that improvement comprising a sintered metal plate extending from the wall of the frame about the marginal face of the matrix, the plate engaging the face of and overlying a portion of the matrix to hold the matrix in position on the plenum and wherein non combustible gas passes through the sintered metal plate.

2. A gas burner as in claim 1 in which the porosity of the sintered metal plate is substantially the same as the porosity of the permeable matrix.

3. A gas burner as in claim 1 in which the sintered metal plate is fastened to the wall of the frame by an L-shaped flange encircling the wall of the frame.

4. A gas burner as in claim 1 in which the peripheral edges of the matrix are sealed to prevent the escape of gas mixtures.

5. A radiant gas burner comprising a first combustible gas plenum chamber with top, side and end walls, a gas permeable matrix received in the open bottom, a second gas plenum surrounding the combustible plenum, a sintered metal plate fastened to the second plenum extending about and engaging the marginal face of the matrix, means to supply a combustible gas to the first plenum and means to supply a non-combustible gas to the second plenum.

* * * * *